US011252526B2

(12) United States Patent
Kumehara et al.

(10) Patent No.: US 11,252,526 B2
(45) Date of Patent: Feb. 15, 2022

(54) ACOUSTIC DEVICE AND HEAD-RELATED TRANSFER FUNCTION SELECTING METHOD

(71) Applicant: Yamaha Corporation, Hamamatsu (JP)

(72) Inventors: Kazuya Kumehara, Hamamatsu (JP); Yukio Tada, Hamamatsu (JP); Mitsuki Tanaka, Hamamatsu (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 17/131,422

(22) Filed: Dec. 22, 2020

(65) Prior Publication Data

US 2021/0306793 A1 Sep. 30, 2021

(30) Foreign Application Priority Data

Mar. 25, 2020 (JP) ..... JP2020-54235

(51) Int. Cl.
*H04S 7/00* (2006.01)
*H04R 5/033* (2006.01)
*H04S 3/00* (2006.01)

(52) U.S. Cl.
CPC ..... *H04S 7/304* (2013.01); *H04R 5/033* (2013.01); *H04S 3/008* (2013.01); *H04S 2400/01* (2013.01); *H04S 2400/11* (2013.01); *H04S 2420/01* (2013.01)

(58) Field of Classification Search
CPC . H04R 5/033; H04S 2420/01; H04S 2400/11; H04S 2400/01; H04S 3/008; H04S 7/304
USPC ..... 381/303
See application file for complete search history.

(56) References Cited

U.S. PATENT DOCUMENTS

2021/0099826 A1* 4/2021 Hassager ..... G06K 9/00335

FOREIGN PATENT DOCUMENTS

JP 2017-103598 6/2017

OTHER PUBLICATIONS

Kentaro Matsui (Nov. 2007) Head-related Transfer Functions From R&D No. 32 [online]. NHK Science & Technology Research Laboratories, [Retrieved: Mar. 5, 2020], Internet < URL: https://www.nhk.or.jp/strl/publica/giken_dayori/jp2/rd-0711.html> ("Matsui 2007").

* cited by examiner

*Primary Examiner* — Paul Kim
(74) *Attorney, Agent, or Firm* — Global IP Counselors, LLP

(57) ABSTRACT

An acoustic device includes binaural speakers, a storing portion for storing a plurality of head-related transfer functions, and a signal processing portion for processing a sound signal with a head-related transfer function. Two or more function candidates are selected from the plurality of head-related transfer functions. Prescribed test sounds are emitted from the speaker. A function candidate to apply to the user is selected based on a discrepancy between a user-perceived location direction and the sound generation location direction for each function candidate.

20 Claims, 4 Drawing Sheets

Profile Table

74

| Profile | | | | | HRTF ID |
|---|---|---|---|---|---|
| Race | Sex | Age | Head Shape | Auricle Shape | |
| East asia | Male | 30 | Round | Square | HRTF 001 |
| | | | | | |

FIG. 4

Selection Log

75

| User ID | Profile | | | | | HRTF ID |
|---|---|---|---|---|---|---|
| | Race | Sex | Age | Head Shape | Head Shape | |
| 101 | White | Male | 45 | Square | Triangular | HRTF 005 |

FIG. 5

ACOUSTIC DEVICE AND HEAD-RELATED TRANSFER FUNCTION SELECTING METHOD

BACKGROUND

Field of Technology

Embodiments disclosed herein relate to a head-related transfer function in an acoustic device for emitting sound to a user so as to locate in a prescribed direction.

Description of the Related Art

In recent years, there have been proposals for technologies by which to implement augmented reality ("AR") through acoustic-based systems, such as that described in Japanese Unexamined Patent Application Publication 2017-103598. Generally described, in such acoustic-based AR systems, an acoustic device, such as headphones, or the like, is placed on a user and sound is reproduced on the acoustic device. However, when sound is reproduced, the acoustic device applies frequency response applying location direction characteristics to the received sound signals. The resulting sound signals experienced by the user an aural perception as if the sounds were being generated from a particular and location direction relative to the user.

In order to achieve acoustic AR, it is necessary to associate or emulate characteristics to sound signals corresponding to a selected position attribute, generally referred to as locating process. The locating process for locating the sound to a selected location position is carried out through convolution of a head-related transfer function and the desired sound signal.

Generally described, "head-related transfer functions" correspond to functions for emulating or estimating the change or modification of sound signals from the established/desired position of the sound source to the ear canals of both ears of the user. Specifically, in one aspect, the head-related transfer function is a function that models how the frequency characteristics of sound that is produced at a location of a sound source, will be changed by physical attributes, such as the shape of the head, the shape of the auricles, and the like, before arriving in the ears of the user. In another aspect, the sound that arrives at both ears of the user from the position of the sound source is further affected with frequency responses that are characteristic of the direction from which the sound arrives. As applied to acoustic AR, a user can the direction from which a sound arrives by recognizing the characteristic frequency response in received sound signals. Consequently, through processing and reproducing sound using a head-related transfer function for a prescribed direction, an AR system is able to cause a perception of hearing the sound from a prescribed direction. Note that while the location of sound is expressed by a location position, which is defined as a direction and a distance, for ease in the description, the explanation below will be primarily for the location direction. The perception of distance of the orientation position can be added relatively easily through adjusting the volume, or the like.

Head-related transfer functions are measured in advance and stored in the acoustic device. When sound is reproduced, the acoustic device applies the frequency response of location direction characteristics by convolving the head-related transfer function with the sound. The sound is reproduced binaurally by headphones, or the like, that are placed on the user. This reproduces sound that has, for the user, the same frequency response as would sound arriving from the selected location direction, enabling the user to hear the sound with an aural perception as if it were being heard from the location direction.

Illustratively, a set of head-related transfer functions are provided for both ears, and for a plurality of directions, to enable location of the sound using binaural reproduction. In some embodiments, a set of head-related transfer functions are configured for individual head-related transfer function to correspond to different prescribed angles in the horizontal plane or vertical plane. For example, an acoustic system can be configured with a set of head-related transfer functions are configured at 10° increments in a range of 360° in the horizontal plane (a full circle) and a range of 0-90° (the zenith) in the vertical plane. Alternatively, setting up the head-related transfer functions may be set having vertical direction components in only the horizontal plane. As described in Kentaro MATSUI (November 2007) Head-related Transfer Functions *From R&D No.* 32 [online]. NHK Science & Technology Research Laboratories, [Retrieved: Mar. 5, 2020], Internet<URL: https://www.nhk.or.jp/strl/publica/giken_dayori/jp2/rd-0711.html> ("Matsui 2007"), head-related transfer functions are measured by inserting microphones into both ears of a model (a test subject) and using the microphones to receive test sounds that are produced from various sound source directions.

SUMMARY

An acoustic device according to at least one embodiment comprises a sound emitting portion that is placed on both ears of a user, a storing portion for storing a plurality of head-related transfer functions, a signal processing portion, and a controlling portion. The signal processing portion performs processing, through a head-related transfer function, a sound signal for emitting sound from the sound emitting portion. The controlling portion executes a head-related transfer function selecting process. The controlling portion, in the head-related transfer function selecting process, executes a series of processes. The controlling portion selects, as function candidates, two or more head-related transfer functions from the plurality of head-related transfer functions. For each of the selected function candidates, the controlling portion processes a prescribed test sound using the function candidates so as to locate, in a sound generating localizing direction that is a prescribed localizing direction, and emits a sound from the sound emitting portion. For each of the selected function candidates, the controlling portion receives a perceived localized direction, which is the localized direction in the perception by the user, of the test sound that has been emitted from the sound emitting portion. For each of the selected function candidates, the controlling portion calculates a location discrepancy that is a discrepancy between the sound generation localization direction and the perceived localized direction. The controlling portion selects a head-related transfer function to apply to the user, based on the location discrepancies of two or more of the aforementioned function candidates.

In a head-related transfer function selecting method according another embodiment, a device equipped with a signal processing portion executes the following steps. The device selects, as function candidates, two or more head-related transfer functions. For each of the selected function candidates, the device performs signal processing on a test sound using the selected function candidates so as to locate, in a sound generating location direction that is a prescribed location direction, and emits a sound from sound emitting portions that are mounted on both ears of a user. The device receives a perceived localized direction, which is the localized direction in the perception by the user, of the test sound that has been emitted from the sound emitting portion. The device calculates and stores a location discrepancy that is a discrepancy between the sound generation location direction and the perceived location direction. The device selects a head-related transfer function to apply to the user based on the location discrepancies of two or more of the aforementioned function candidates.

The embodiments described above can enable the selection of an appropriate head-related transfer function using a simple process.

BRIEF DESCRIPTIONS OF THE DRAWINGS

FIG. 4 is a diagram depicting an example of a profile table.

FIG. 5 is a diagram depicting an example of a selection log.

DETAILED DESCRIPTION

Because the head-related transfer function is determined by, primarily, the user's head shape and auricle shape, ideally a head-related transfer function that has been measured for the specific user is used in locating sound. However, the use of the equipment described in Matsui 2007, to measure the head-related transfer functions for each individual user would be extremely burdensome, and is thus not practical. Given this, while one may consider the use of a head-related transfer function of a model that resembles the user, the selection of the appropriate head-related transfer function from among a plurality of head-related transfer functions that have been prepared in advance typically requires a large amount of computing resources in the selection algorithms Accordingly, current approaches to use of head-related transfer functions are inefficient and do not scale well.

Figure 1:
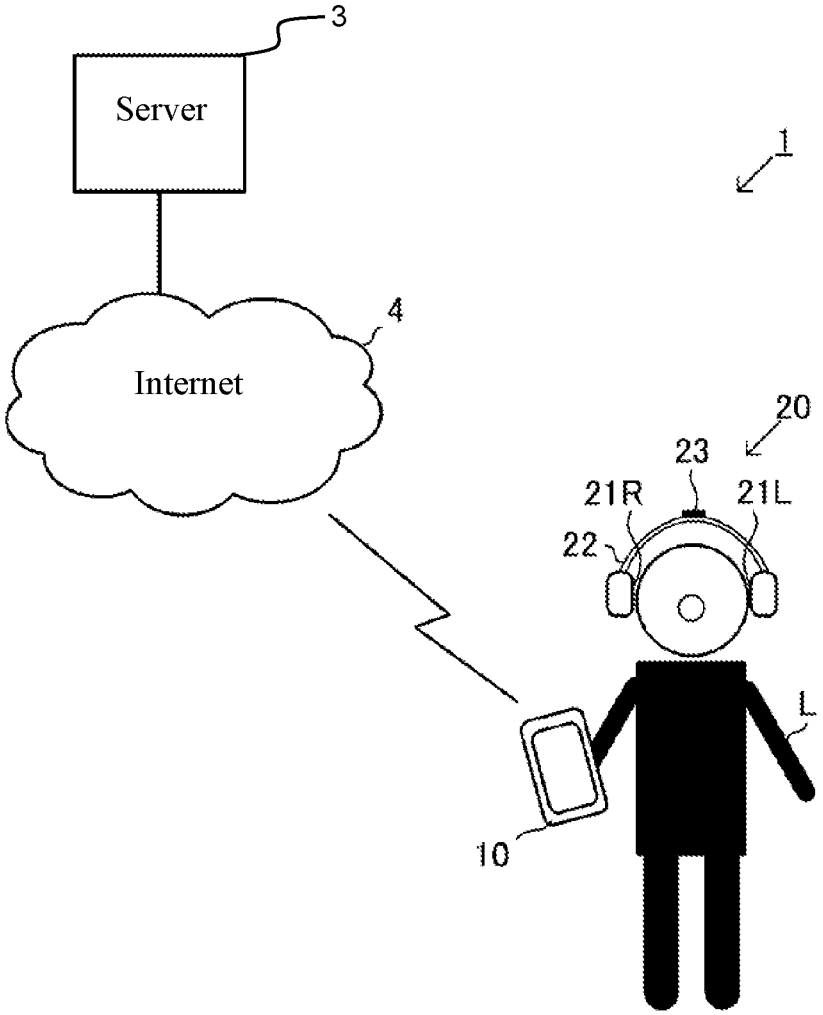
FIG. 1 is a diagram depicting the structure of a sound reproducing system to which an embodiment is applied.
Figure 2:
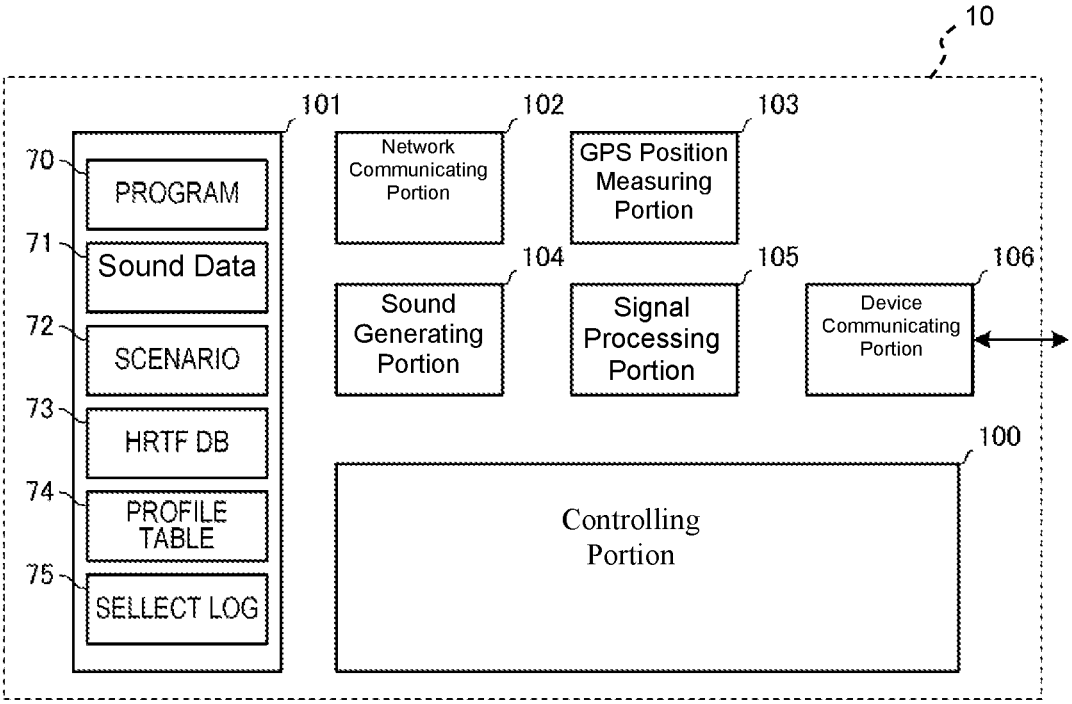
FIG. 2 is a block diagram of a mobile terminal device to which an embodiment is applied.
Figure 3:
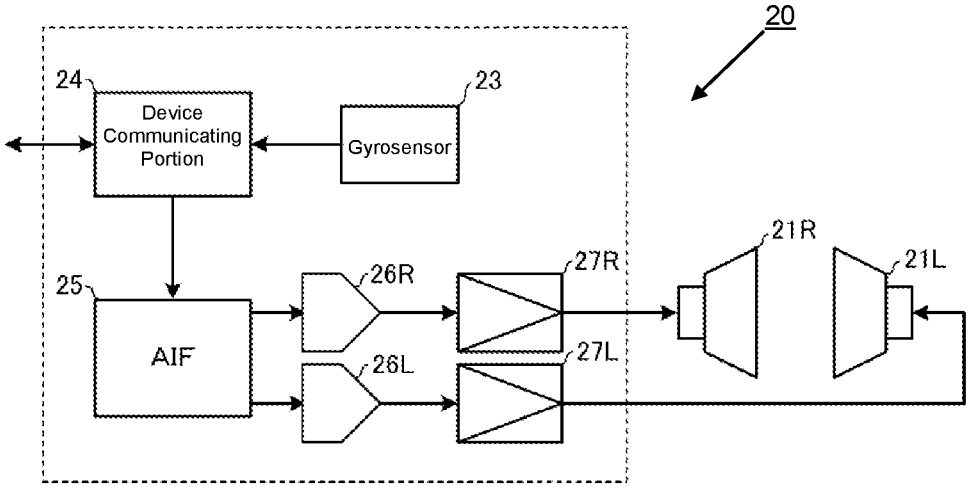
FIG. 3 is a block diagram of headphones to which an embodiment is applied.

FIG. 1 is a structural diagram of a sound reproducing system 1 to which an embodiment is applied. FIG. 2 is a block diagram of a mobile terminal device 10 to which an embodiment is applied. FIG. 3 is a block diagram of headphones 20 to which an embodiment is applied. The sound reproducing system 1 includes a mobile terminal device 10 and headphones 20, which are an acoustic device. FIG. 1 shows the state wherein a user L holds the mobile terminal device 10 in his or her hands and places the headphones 20 on both ears. The mobile terminal device 10 uses, for example, a smart phone (a multifunctional mobile telephone). The mobile terminal device 10 is connected (paired) with the headphones 20 through Bluetooth® to enable communication therebetween. There is no limitation to the connection between the mobile terminal device 10 and the headphones 20 being through Bluetooth; it may be through another wireless communication standard or through a physical cable instead.

The mobile terminal device 10 communicates with a server 3 through a network 4, which may be the Internet. The headphones 20 are of an over-the-ear type, combining two speaker drivers 21R and 21L and a headband 22. The headphones 20 have a three-axis gyrosensor (sensor) 23 on the headband 22, to enable tracking of the orientation of the head of the user L. Note that earphones may be used instead of the headphones 20 as the acoustic device. The server 3 communicates with a plurality of mobile terminal devices 10, and stores a selection log, or the like, of one or more sets of head-related transfer functions collected from the mobile terminal devices. Moreover, the server 3 stores a plurality of sets head-related transfer functions, and, as necessary, downloads head-related transfer functions to the sound reproducing system 1.

With continued reference to FIGS. 1 and 2, the mobile terminal device 10, through an application program 70, executes a head-related transfer function selecting process and a content playback process. The mobile terminal device 10, through cooperation of the application program 70 and hardware, including a controller 100, that executes instructions facilitating the selection of one or more sets of head-related transfer functions as described herein. More specifically, in an illustrative embodiment, the mobile terminal device 10, in cooperation with the application program 70 facilities one or more of generating prescribed test sounds for location testing, processing input signals to determine a perceived location by a user, measuring discrepancy between perceived location and the prescribed test sounds, and selecting one or more sets of head-related transfer functions as described herein.

The sound reproducing system 1 locates, in a prescribed direction with respect to the user L, the sound that is reproduced. A head-related transfer function is used in this location process. The head-related transfer function is a function that expresses differences in reception frequency response based on a generated model that accounts for various sound signal interference or modifications, including head shape, auricle shapes, and the like, between a specified virtual position of a sound signal and arrival at the ears of the user L.

The sound reproducing system 1 has a plurality of target sets of head-related transfer functions stored in advance therein, and selects therefrom a set of head-related transfer functions that is optimal for the user L, as part of a sound generation process. Once selected the different configured head-related transfer functions from the selected set of head-related transfer functions can be applied to sound signals to emulate the characteristics of direction or location. For example, sound signals configured with characteristics of sound originating from 20 degrees along the horizontal plane can be convolved with a corresponding head-related transfer function from the selected set of head-related transfer functions.

Illustratively, plurality of target sets of head-related transfer functions were measured using models (test subjects) that are associated with different profiles. As depicted in the profile table 74 in FIG. 4, a profile is information that can be considered to have an effect on determining the head-related transfer function for a model, such as the race, sex, age, head shape, auricle shape, and the like for the model on which the head-related transfer function was measured. The profile for a model on which a head-related transfer function was measured is referred to as a "head-related transfer function profile," in the description set forth below. Note that the head-related transfer functions may use transfer functions that are produced automatically, such as by taking a plurality of measurement data.

The following steps are carried out in the selection of a set of head-related transfer functions from a plurality of potentially applicable plurality of sets of head-related transfer functions. With the headphones 20 mounted on the head, the user L inputs his or her profile into the mobile terminal device 10. The sound reproducing system 1 selects, as candidates, head-related transfer functions that are associated with profiles or characterized as being similar to the profile that has been inputted. The sets of head-related transfer functions that have been selected as candidates are termed "function candidates." A plurality of function candidates (e.g., a plurality of sets of head-related transfer functions) is selected. The sound reproducing system 1 generates a prescribed test sound using a selected function candidate. That is, the mobile terminal device 10 generates a prescribed test sound and performs a convolution calculation of the head-related transfer function that applies to a prescribed location direction on the test sound (e.g., an individual head-related function that has been configured to the characteristic of the location attribute of the sound). The location frequency response applied to the test sound through the convolution calculation are characteristics for locating to the "prescribed location direction" for the model for the function candidate, rather than for the user L who hears the test sound. The prescribed location direction applied through the convolution calculation shall be termed the "generated sound location direction."

This test sound that has been calculated through the convolution is outputted to the headphones 20, to emit sound toward the user L. The test sound to which the convolution calculation of the function candidate has been applied has a location frequency response for the user L, and thus will be perceived by the user L as located in some location direction even if not matching the generated sound location direction. This location direction shall be termed the "perceived location direction."

The user L listens to the test sound, and inputs into the system the direction, in terms of aural perception, in which the sound is located, that is, inputs a perceived location direction. The sound reproducing system 1 measures and records a location discrepancy, which is the difference between the generated sound location direction and the perceived location direction. This difference is information such as an angular difference, the direction of the discrepancy, or the like.

The sound reproducing system 1 carries out the process above for all of the selected function candidates, to calculate or measure a location discrepancy for each function candidate. The optimal head-related transfer function for the user L is determined from among the plurality of function candidates based on these location discrepancies. The optimal head-related transfer function that has been determined is used in locating the sound data that is the content in the content playback process.

The following steps are executed by the sound reproducing system 1 in the content playback process. The mobile terminal device 10 detects the location, time, etc. where the user L is present, to reproduce sound, depending on the location and time, when a prescribed location, time, or the like is reached. The sound that is reproduced is located in a predetermined direction. The mobile terminal device 10 calculates a location direction (relative location direction) for the sound with respect to the direction faced by the head of the user L, based on the current location of the user L, the orientation of the head of the user L, and the location position of the sound. The mobile terminal device 10 reads out, into the signal processing portion 105, the head-related transfer function for the angle corresponding to the relative location direction, from the selected head-related transfer functions (function set) determined in the head-related transfer selecting process. The signal processing portion 105 performs convolution signal processing of the head-related transfer function on the sound signal that has been reproduced. The sound signal that has been subjected to the signal processing is transmitted to the headphones 20. The sound received by the headphones 20 is outputted from the speakers 21R and 21L. This enables the user L to listen to the sound with a perception as if it is being heard from a prescribed direction.

The mobile terminal device 10 is explained in detail with reference to FIG. 2. The mobile terminal device 10 is a smart phone that includes a controlling portion 100, a storing portion 101, a network communicating portion 102, a GPS position measuring portion 103, a sound generating portion 104, a signal processing portion 105, and a device communicating portion 106. The controlling portion 100 includes a CPU. The storing portion 101 includes a ROM, a RAM, and a flash memory.

The storing portion 101 stores an application program 70, sound data 71, a scenario file 72, a head-related transfer function data store 73, a profile table 74, and a selection log 75.

The application program 70 one or more programs or program modules for causing the mobile terminal device 10 and the headphones 20 to implement at least a portion of the sound reproducing system 1 according to the present embodiment. The sound data 71 includes a test sound that is played back when selecting the head-related transfer function (e.g., prescribed test sound), and sound data as content to be played back based on the scenario file 72. The scenario file 72 is a file wherein playback events of the content sound data are recorded, and is used in the content playback process. For each event, the timing of playback of the sound data, the location position for the sound that has been reproduced, and identification information for the sound data that has been reproduced are stored in the scenario file 72.

A plurality of head-related transfer functions is stored in the head-related transfer function data store 73. Illustratively, individual sets of head-related transfer functions were measured, or otherwise attributed to, a model with different profile characteristics. The profile table 74 is a table of stored profiles associated with individual head-related transfer functions that are stored in the head-related transfer function database 73. When, in the head-related transfer function selecting process, the user L inputs his or her own profile (e.g., defined by one or more items described below), the profile table 74 is referenced using this user-input profile, and one or more sets of head-related transfer function that has a similar profile are selected as a function candidate. The selection log 75 records the selection results of the head-related transfer function selecting process. Although illustrated as part of the mobile terminal device 10, in other embodiments, one or more the head-related transfer function data store 73, profile table 74, select logs 75 may include a complimentary application on the server 3 and can cooperate in the execution of the functions described for each component herein.

FIG. 4 is a diagram depicting an example of a profile table 74. Respective profiles (of the models) of respective head-related transfer functions that are stored in the head-related transfer function database 73 are each stored in the profile table 74. In this example, illustrative characteristics of a set of users, such as race, gender, age, head shape, and auricle shape are stored as the profile. "Gender" and "Age" are indicators for estimating the body size and shape of the model and of the user L. "Head shape" expresses a shape such as, for example, round, square, V-shaped, pentagonal, or the like, and is an important element in determining the head-related transfer function. "Auricle shape" is expressed as, for example, round, square, triangular, or the like, and is an important element in determining the head-related transfer function. In the example in FIG. 4, head-related transfer functions are classified by the profiles described above, but profiles are not limited thereto. For example, the height and weight of the model may also be included in the profile items.

In the head-related transfer selecting process, the user L inputs or selects, one or more user metrics used defining the profile table 74. The sound reproducing system 1 compares the user metrics inputted by the user L to the various head-related transfer function profiles stored in the profile table 74, to identify a set of function candidates based at least part matching user metrics. Illustratively, the selection of the function candidates can be based on a number of matching metric values in which each matching user metric in the profile may be handled as having equal weight. Alternatively, one or more user metrics may be weighted such as through increasing the coefficients thereof. Moreover, in other embodiments, a default profile may be selected based on information that is set in advance in the mobile terminal device 10, such as the region wherein the user L lives, the language that is used, or the like. In this case, the mobile terminal device 10 may store, in a storing portion 101, a table that defines the correspondence between profiles and various types of information that have been set in advance. The accuracy of selection of a profile can be increased easily through the mobile terminal device 10 selecting a profile based on the table.

FIG. 5 is a diagram depicting an example of a selection log 75. The selection log 75 records the selection results of the head-related transfer function selecting process. That is, in the head-related transfer function selecting process, the user ID of the user L, the profile inputted by the user L, and the head-related transfer function ultimately selected by the user L for application are stored in correspondence with each other. The content of the selection log 75 is uploaded to the server 3, either at regular or irregular intervals.

Returning to FIG. 2, the network communicating portion 102 communicates with the server 3 through the network 4. The controlling portion 100 uses the network communicating portion 102 to upload the content of the selection log 75 to the server 3. In the present embodiment, the head-related transfer function data store 73 is stored in the storing portion 101 of the mobile terminal device 10. Alternatively, at least some portion of the information stored on the server 3. In this case, the mobile terminal device 10 may use the profile of the user L to reference the profile table 74 to select a plurality of function candidates (head-related transfer functions), to download the selected head-related transfer functions from the server 3. The GPS position measuring portion 103 receives signals from GPS (Global Positioning System) satellites to measure the position thereof accurately.

The sound generating portion or sound emitter 104 generates the sound that is to be outputted to the headphones 20, e.g., in the form of a sound signal. The sound signal generated by the sound generating portion 104 is inputted into the signal processing portion 105. The head-related transfer function is set in the signal processing portion 105. Specifically, the signal processing portion 105 is structured as a finite impulse response (FIR) filter, which are typically implemented as a series of delays, multipliers and adders that create the FIR output as a weighted average of a set of inputs. Illustratively, the head-related transfer function has been transformed into the time domain, are set as the filter coefficients. Illustratively, The signal processing portion 105 convolves the head-related transfer function (head impulse response) with the sound signal to process the sound with frequency characteristics that sound as if they are from the prescribed direction.

The device communicating portion 106 communicates with the headphones 20, which is a linked Bluetooth device. The device communicating portion 106 not only transmits a sound signal to the headphones 20, but also receives values detected by the gyrosensor 23 of the headphones 20.

The structure of the headphones 20 is explained below with reference to the block diagram of FIG. 3. The headphones 20 comprise speakers 21L and 21R, a gyrosensor 23, a device communicating portion 24, an AIF 25, DACs 26L and 26R, and amplifiers 27L and 27R.

The device communicating portion 24 communicates with the mobile terminal device 10 (device communicating portion 106), via a near-field wireless communication, including but not limited Bluetooth, etc. The AIF (Audio Interface) 25 transmits the sound signal that has been received from the mobile terminal device 10 to the DACs 26L and 26R, for the left and right channels. The DACs (Digital-to-Analog Converters) 26L and 26R convert, to analog signals, the digital signals that have been inputted from the AIF 25. The amplifiers 27L and 27R amplify, and supply to the speaker drivers 21L and 21R, the analog signals inputted from the DACs 26L and 26R. Through this, the sound signals received from the mobile terminal device 10 are emitted from the speaker drivers 21L and 21R as acoustic sound. As described above, the sound signals have been subjected to signal processing to be located to a predetermined position, enabling the user L to hear sound as if the sound were produced from the predetermined position, despite the user L moving or changing the orientation of his or her head.

Figure 6:
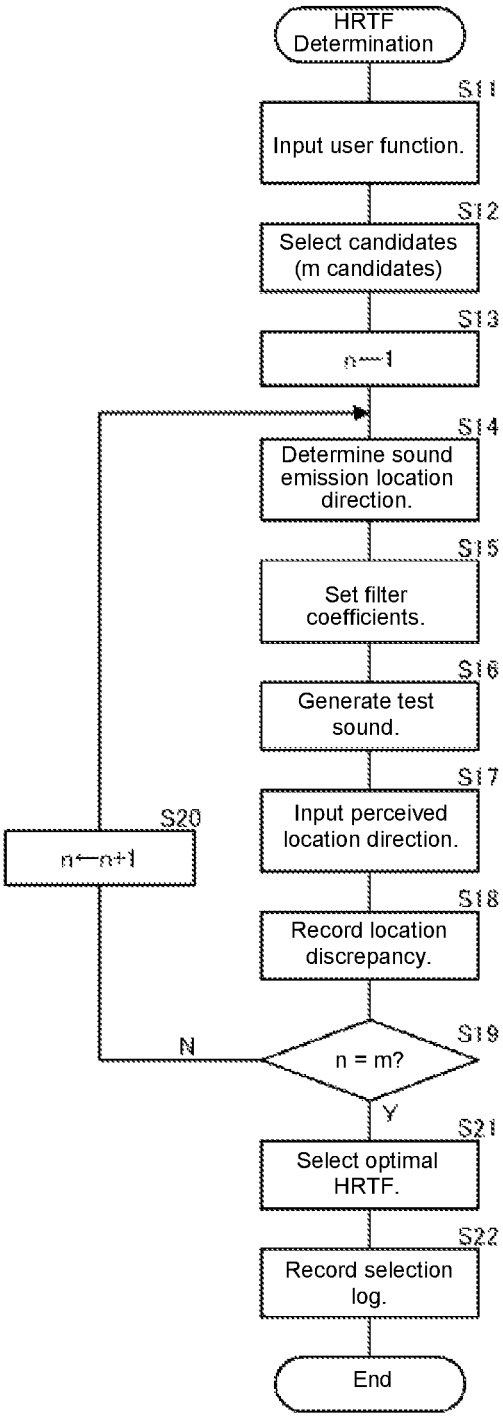
FIG. 6 is a flowchart depicting a head-related transfer function selecting process.

The head-related transfer function selecting process is explained below with reference to the flowchart in FIG. 6. In the present embodiment, the head-related transfer function selecting process is executed by the controlling portion 100 of the mobile terminal device 10. In FIG. 6, the user L inputs his or her profile (S11). The mobile terminal device 10 references the profile table 74 using the inputted user profile, to select a plurality of head-related transfer functions (function candidates) as candidates (S12). Let us define the number of function candidates selected in S12 as m.

An index n (where index n=1 through m), which points to the function candidate to be tested, is set to 1 (S13). In a test, the user L evaluates a perceived direction from which the test sound, which has been located using a function candidate n, is heard. The mobile terminal device 10 determines the location direction (the sound generation location direction) of the test sound (S14). The location direction of the test sound may be set in advance to a single direction, or may set to a different direction each time, in order to prevent developing an expectation by the user L. Moreover, the mobile terminal device 10 moving the location direction of the test sound back and forth slightly, centered on the sound generating location direction that has been determined, will enable the user L to identify the location direction more easily. The process for moving the sound generation location direction back and forth may be through slightly increasing and decreasing one or more filter coefficients for the head impulse response that are set in the signal processing portion 105.

The mobile terminal device 10 reads out a single-direction head-related transfer function, for the location direction, from the nth function candidate set, and loads it into the signal processing portion 105 (S15). After the head-related transfer function has been set, the mobile terminal device 10 generates the test sound (S16).

When the test sound is produced, the user L inputs the perceived test sound location direction (the perceived location direction) (S17). The inputting of the perceived location direction by the user L may be through any method. For example, a method may be used wherein the user L points the mobile terminal device 10, which he or she is holding, in the perceived location direction, or the user L may incline his or her head toward the perceived location direction, with the direction thereof detected by the gyrosensor 23.

Because the function candidate is not the head-related transfer function of the user L himself/herself, there may be a discrepancy between the sound generation location direction and the perceived location direction that is perceived by the user L. The location discrepancy is calculated and recorded (S18). The magnitude of the discrepancy (the absolute value of an angle), and the direction of the discrepancy (the relative angle from the sound generation location direction to the perceived location direction), and the like, are recorded as the location discrepancy.

The mobile terminal device 10 executes the processes S14 through S18 repeatedly for the function candidates, n times (1 through m) (S19, S20). The processes in S14 through S18 are the processes for generating the prescribed test sound and measuring the location discrepancy between the sound generation location direction and the perceived location direction that is perceived by the user L. After the location discrepancies for function candidates 1 through m have been calculated and recorded, the optimal head-related transfer function is determined from among the function candidates 1 through m based on this record (S21). While there is no limitation on the method for determining the head-related transfer function, a technique may be employed such as, for example, selecting the function with the minimum difference in angles or selecting the function with the minimum difference in angles in the horizontal direction, or the like. Given this, the selection result this time is recorded in the selection log 75 along with the profile of the user L (S22). In alternative embodiments, mobile terminal device 10 may instead select a plurality of function candidates based on the location discrepancy and interpolate these function candidates to apply to the user.

If, in the head-related transfer function selecting process in FIG. 6, there is no profile inputted by the user L, the selection log 75 may reference the past to select, for this time as well, a head-related transfer function that had been selected previously.

The following aspects can be understood from the embodiment described in detail above.

An acoustic device according to one embodiment comprises a sound emitting portion that is placed on both ears of a user, a storing portion for storing a plurality of head-related transfer functions, a signal processing portion, and a controlling portion. The signal processing portion performs processing, through a head-related transfer function, on a sound signal for emitting sound from the sound emitting portion. The controlling portion executes a set of head-related transfer functions selecting process. The controlling portion, in the head-related transfer function selecting process, executes one or more processes. The controlling portion selects, as function candidates, two or more head-related transfer functions from the plurality of head-related transfer functions. For each of the selected function candidates, the controlling portion processes a prescribed test sound using the function candidates so as to locate, in a sound generating localizing direction that is a prescribed localizing direction, and emits a sound from the sound emitting portion. For each of the selected function candidates, the controlling portion receives a perceived localized direction, which is the localized direction in the perception by the user, of the test sound that has been emitted from the sound emitting portion. For each of the selected function candidates, the controlling portion calculates a location discrepancy that is a discrepancy between the sound generation localization direction and the perceived localized direction. The controlling portion selects a head-related transfer function to apply to the user based on the location discrepancies of two or more of the function candidates. The controlling portion selects, for example, a function candidate wherein the location discrepancy does not exceed a prescribed threshold value.

In one aspect, the sound emitting portion may be headphones or earphones.

In one aspect, the controlling portion may select two or more function candidates instead of selecting a single head-related transfer function from the plurality of function candidates. The controlling portion may apply to the user a new head-related transfer function produced through interrelation of these selected function values.

In one aspect, a location detecting portion for detecting the orientation of the head of the user may further be provided. The controlling portion may acquire, as the perceived location direction, a detected direction of the location detecting portion when the user has turned to face a test sound that has been heard.

In one aspect, the acoustic device may be structured through connection of an audio playback device, either through a cable or wirelessly. A part or all of the storing portion, the signal processing portion, and the controlling portion may be provided in the audio playback device.

In one aspect, the audio playback device or the sound emitting portion may be provided with a network communicating portion. A portion of the storing portion and the controlling portion may be located on a server on a network.

In one aspect, the controlling portion may send, to the server, information for function candidates selected for application to the user. The server may collect head-related transfer function selection information from a plurality of acoustic devices.

In one aspect, head-related transfer function for (a variety of) different profiles may be stored as a plurality of head-related transfer functions. Head-related transfer functions of profiles that are similar to the profile of the user may be selected as function candidates.

Modified Example 1

In the embodiment above, the mobile terminal device 10 was configured so as to produce one test sound for each function candidate. However, the configuration may instead be such that a plurality of test sounds is produced with, respectively, different sound generating location directions for each of the function candidates. In this case, the mobile terminal device 10 should repeat the steps S14 through S18 a plurality of times for a given function candidate.

Modified Example 2

In the embodiment set forth above the mobile terminal device 10 selected a single function candidate based on the location discrepancy and applied that function candidate (head-related transfer function) to the user L. However, the mobile terminal device 10 may instead select a plurality of function candidates based on the location discrepancy and interpolate these function candidates to apply to the user.

Modified Example 3

In the embodiment set forth above the acoustic device, was structured from a combination of a mobile terminal device 10 and headphones 20. However, the entire structure of the acoustic device according to some embodiments may instead be consolidated in the headphones 20.

Modified Example 4

A portion of the structure of the acoustic device according some embodiments may instead be located on the server 3 on the network. For example, the head-related transfer function database 73 may be located on the server 3, and the function candidates selected based on the profile may be downloaded from the server 3.

Modified Example 5

In the embodiments set forth above the function candidates were selected based on the profile inputted by the user. However, a sensor such as a camera may be equipped in the headphones that are placed on the user, and head tracking data may be acquired through the sensor. The system would estimate the shape of the head of the user based on the head tracking data, to select automatically the function candidates or the head-related transfer function to be set for the user.

What is claimed is:

1. An acoustic device comprising:

a sound emitter that includes two or more speaker drivers for binaural reproduction of sound signals;

a head-related transfer function data store that maintains a plurality of sets of head-related transfer functions;

a signal processor for convolving incoming sounds signals with a selected head-related transfer function to provide an output sound signal generated by the sound emitter; and a controller, implemented by a processor executing computer-executable instructions that cause the controller to select a set of head-related transfer functions from a plurality of head related transfer functions including:

selecting as function candidates two or more sets of head-related transfer functions from the plurality of sets of head-related transfer functions;

for individual function candidates:

convolving a prescribed test sound in accordance with a selected head-related transfer function of the function candidates, so as to locate, a sound generating location direction that is a prescribed location direction;

acquiring a perceived location direction of the convolved prescribed test sound;

measuring location discrepancy corresponding to a discrepancy between the sound generation location direction and the perceived location direction, and selecting at least one set of head-related transfer functions based on a comparison of location discrepancy measurements.

2. The acoustic device as set forth in claim 1, wherein the sound emitter includes at least one of headphones or earphones.

3. The acoustic device as set forth in claim 1, wherein the controller selects that at least one selected set of head-related transfer function based on interpolation of values of two selected function candidates.

4. The acoustic device as set forth in claim 1 further comprising a location detector that generates signals corresponding to a detected orientation of a head of a user, wherein the controller determines a perceived location direction as a detected direction of the location detector responsive to the generation of the convolved prescribed test sound.

5. The acoustic device as set forth in claim 1 further comprising a device communicator for receiving information from an external device.

6. The acoustic device as set forth in claim 1 further comprising a network communicator for transmitting information to a network resource via a communication network.

7. The acoustic device as set forth in claim 6, wherein the network communicator receives information from the network resource.

8. The acoustic device as set forth in claim 6, wherein the network communicator transmits the selected function candidate to the network resource.

9. The acoustic device as set forth in any of claim 1, wherein the controller selects as function candidates based, at least in part, on an inputted profile associated with a user.

10. A method for selecting a set of head-related transfer functions for utilization in acoustic device, comprising:

identifying two or more sets of head-related transfer functions from a plurality of sets of head-related transfer functions, wherein individual sets of head-related transfer functions include individual head-related transfer functions are organized according to individual angular measurements relative to at least one of a horizontal plane or vertical plane relative to the acoustic device;

for individual sets of the head-related transfer functions for the two or more sets of head-related transfer functions:

processing a prescribed test sound with an individual head-related transfer function selected according to a selected angular measurement;

measuring a location discrepancy between the selected angular measurement and a direction signal responsive to the processed, prescribed test sound, the direction signal attributed to a user wearing the acoustic device;

selecting a set of head-related transfer functions based, at least in part, on a comparison of the measured location discrepancies for the two or more sets of head-related transfer functions.

11. The method for selecting a set of head-related transfer functions for utilization in acoustic device as set forth in claim 10, wherein selecting a set of head-related transfer functions based, at least in part, on a comparison includes interpolating two identified sets of head-related transfer functions to form the selected set of head-related transfer functions.

12. The method for selecting a set of head-related transfer functions for utilization in acoustic device as set forth in claim 10, wherein measuring a location discrepancy between the selected angular measurement and a direction signal responsive to the processed, prescribed test sound and attributed to a user wearing the acoustic device includes determining an orientation of the acoustic device.

13. The method for selecting a set of head-related transfer functions for utilization in acoustic device as set forth in claim 10 further comprising transferring the selected set of head-related transfer functions to a network-based component.

14. The method for selecting a set of head-related transfer functions for utilization in acoustic device as set forth in claim 10, wherein identifying two or more sets of head-related transfer functions from a plurality of sets of head-related transfer functions includes selecting the two or more sets of head-related transfer functions based on profile information inputted by a user.

15. The method for selecting a set of head-related transfer functions for utilization in acoustic device as set forth in claim 14, wherein selecting the two or more sets of head-related transfer functions based on profile information inputted by a user includes selecting the two or more sets of head-related transfer function based on at least one inputted physical characteristic of the user.

16. A system comprising:

a head-related transfer function data store that maintains a plurality of sets of head-related transfer functions, wherein individual sets of head-related transfer functions include individual head-related transfer functions are organized according to individual angular measurements relative to at least one of a horizontal plane or vertical plane relative to an acoustic device; and a controller, implemented by a processor executing computer-executable instructions that cause the controller to select a set of head-related transfer functions from a plurality of head related transfer functions including:

selecting as function candidates, two or more sets of head-related transfer functions from the plurality of sets of head-related transfer functions;

for individual function candidates:

causing a convolution of a prescribed test sound in accordance with a selected head-related transfer function of the function candidates, so as to locate, a sound generating location direction that is a prescribed location direction, measuring location discrepancy corresponding to a discrepancy between the sound generation location direction and a perceived location direction, and selecting a set of head-related transfer functions based on location discrepancy measurements.

17. The system as set forth in claim 16, wherein the controller causes the convolution of the prescribed test sound by transmitting a convolved signal to a sound emitter.

18. The system as set forth in claim 16, wherein the controller causing a convolution of the prescribed test sound according a first angular measurement for a first function candidate and a second angular measurement for a second function candidate.

19. The system as set forth in claim 16, wherein the control selects the function candidates based on inputted profile information associated with a user.

20. The system as set forth in claim 16, wherein the controller transmits the selected a set of head-related transfer functions based on a comparison of location discrepancy measurements to an acoustic device.

* * * * *